United States Patent [19]

Benson, Jr.

[11] 4,199,466

[45] Apr. 22, 1980

[54] ACTIVATED BLEACHING PROCESS AND COMPOSITIONS THEREFOR

[75] Inventor: Herbert L. Benson, Jr., Cypress, Tex.

[73] Assignee: Shell Oil Company, Houston, Tex.

[21] Appl. No.: 934,741

[22] Filed: Aug. 21, 1978

[51] Int. Cl.[2] ..... C11D 7/18; C11D 7/32; C11D 7/54

[52] U.S. Cl. ..... 252/95; 8/107; 252/99; 252/102; 252/103; 252/186; 544/163; 546/246

[58] Field of Search ..... 252/95, 99, 103, 102, 252/186; 260/465.5 R, 551; 544/163, 402; 546/246; 8/107, 111

[56] References Cited

U.S. PATENT DOCUMENTS

| | | | |
|---|---|---|---|
| 2,194,076 | 3/1940 | Roblin | 260/551 |
| 2,300,597 | 11/1942 | Roblin | 260/551 |
| 2,331,670 | 10/1943 | Ericks et al. | 260/551 |
| 2,375,628 | 5/1945 | D'Alelio et al. | 544/163 |
| 2,859,216 | 11/1958 | Pattison | 544/402 |
| 2,927,840 | 3/1960 | Dithmar et al. | 8/111 |
| 3,163,606 | 12/1964 | Vireen et al. | 252/98 |
| 3,384,596 | 5/1968 | Moyer | 252/187 |
| 3,756,774 | 9/1973 | Kirner | 8/111 |
| 3,824,188 | 7/1974 | Loffelman et al. | 252/95 |
| 3,882,035 | 5/1975 | Loffelman et al. | 252/95 |
| 3,986,972 | 10/1976 | Loffelman et al. | 252/102 |
| 3,986,973 | 10/1976 | Loffelman et al. | 252/102 |
| 4,025,453 | 5/1977 | Kravetz et al. | 252/102 |
| 4,086,175 | 4/1978 | Kravetz et al. | 252/99 |
| 4,086,177 | 4/1978 | Kubitschek et al. | 252/102 |
| 4,101,506 | 7/1978 | Uhrham et al. | 260/45.8 N |

FOREIGN PATENT DOCUMENTS

| | | | |
|---|---|---|---|
| 48-76877 | 10/1973 | Japan | 546/246 |
| 907358 | 10/1962 | United Kingdom | 252/98 |

*Primary Examiner*—P. E. Willis, Jr.

[57] ABSTRACT

A process for the activation of peroxide-based bleaches comprising conjointly incorporating into an aqueous medium a peroxide-based bleach, sufficient buffering agent to maintain the aqueous medium under alkaline conditions, and a cyanoamine of the general formula

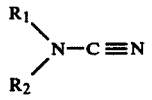

as a peroxide activator. Stable peroxide-based bleaching and detergent compositions are also disclosed.

28 Claims, No Drawings

ACTIVATED BLEACHING PROCESS AND COMPOSITIONS THEREFOR

BACKGROUND OF THE INVENTION

1. Field of the Invention

The present invention relates to an improved process for activating peroxide-based bleaches. In addition, it relates to bleach and bleach-containing detergent compositions which alone or in combination with other ingredients, can be added to an aqueous medium to effect the bleaching of fibrous materials and other bleachable substances over a wide range of temperatures.

2. Description of the Prior Art

Peroxide-based bleaches, such as hydrogen peroxide and perborates, are well known in the art and have been used for a number of years for bleaching textiles, and more recently, in home laundering applications for the bleaching of fabrics which cannot be safely bleached with chlorine-based bleaches because of problems with fiber and/or color damage. However, for home laundering use peroxide-based bleaching agents generally have the disadvantage, as compared to chlorine-based bleaches, that their bleaching effectiveness falls off rapidly as the temperature decreases. For example, peroxide-based bleaches are relatively ineffective at 60°-160° F., which are typical temperatures for home laundering in the United States.

Considerable effort has been devoted over the years to improve the effectiveness of peroxide-based bleaches at lower temperatures. As a result of this effort a variety of compounds have been discovered which activate peroxide-based bleaches. Representative of such activators are the carboxylic acid amide activators disclosed in Dithmar et al U.S. Pat. No. 2,898,181, the organic nitrile activators disclosed in a later Dithmar et al patent, U.S. Pat. No. 2,927,840, the imide activators disclosed in Murray U.S. Pat. No. 3,928,223, the halotriazine activators disclosed in Villaume U.S. Pat. No. 3,945,937 and Loffelman et al U.S. Pat. No. 3,947,374 and U.S. Pat. No. 3,986,971, and the acyl nitrile activators disclosed in Loffelman et al U.S. Pat. No. 3,986,972. Among the more recently discovered and highly effective peroxide-based bleach activators are acid cyanamide and certain metal cyanamides described in Kravetz et al U.S. Pat. No. 4,025,453, Kravetz et al U.S. Pat. No. 4,086,175 and Kubitschek et al U.S. Pat. No. 4,086,177.

Despite the extensive efforts devoted by those skilled in the art to finding suitable activators for peroxide-based bleaches, there is in the United States today little practical application of this technology, although some of the more recently discovered activators do show commercial promise. However, there remains a continuing need in the art for even more effective activators, which are also storage stable, non-toxic and do not have an unpleasant odor. The present invention provides a bleach activation process and related compositions based on a novel class of activators, which when employed under alkaline conditions provide substantially improved bleaching activity, and do not suffer from the drawbacks found with most of the prior art activators, or at least to a substantially lesser degree.

SUMMARY OF THE INVENTION

It has now been found, and forms the basis of the present invention, that certain cyanoamine compounds when employed under alkaline conditions are surprisingly effective activators for peroxide-based bleaches over a wide range of temperatures and also exhibit very desirable stability properties. The cyanoamine compounds which can be suitably employed in accordance with the invention have an equivalent weight (molecular weight/number of NCN groups) of about 44 to about 600 and are represented by the formula:

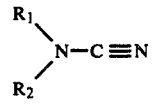

where $R_1$ and $R_2$ taken together with the amino nitrogen to which they are attached form a ring containing 4 to 6 carbon atoms, which carbon atoms may be substituted with a $C_1$–$C_5$ alkyl, $C_1$–$C_5$ alkoxy, $C_1$–$C_5$ alkanoyl, phenyl, middle halogen, amino, amine salt, cyano or cyanoamino group, or with a nitrogen-containing heterocyclic group of 4 to 6 carbon atoms where the nitrogen atom is substituted with a cyano group; or where $R_1$ and $R_2$ taken together with the amino nitrogen to which they are attached are part of a heterocyclic ring of 5 to 7 atoms containing in addition to the indicated nitrogen, one or two additional hetero atoms selected from the group consisting of O, S and N-$R_3$, where $R_3$ is hydrogen or a $C_1$–$C_5$ alkyl, $C_2$–$C_5$ alkenyl, $C_2$–$C_5$ alkynyl, phenyl, $C_7$–$C_9$ aralkyl, $C_5$–$C_7$ cycloalkyl, $C_1$–$C_5$ alkanoyl or cyano group, or another heterocyclic ring of 5 to 7 atoms containing one to three nitrogen atoms substituted with a cyano group, and where the carbon atoms of the first heterocyclic ring or substituent heterocyclic ring can be substituted with a $C_1$–$C_5$ alkyl, $C_1$–$C_5$ alkoxy, $C_1$–$C_5$ alkanoyl, middle halogen, amino, amine salt, cyano or cyanoamino group; or where $R_1$ and $R_2$ are the same or different and independently represent hydrogen, $C_1$–$C_{20}$ alkyl (straight chain, branched chain or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, $C_7$–$C_{20}$ aralkyl, alkenylcyanoamino or a polyalkenylamino of the type

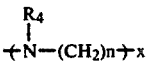

where n=1-2 and x is 1-10 and $R_4$ is H or cyano, a Group IA metal, or any of the foregoing radicals containing a substitutable carbon atom on which is substituted a $C_1$–$C_5$ alkyl, $C_1$–$C_5$ alkoxyl, $C_1$–$C_5$ alkanoyl, middle halogen, amino or an amine salt, cyano, cyanoamino, or hydroxyl group, provided that when either of $R_1$ or $R_2$ is hydrogen or a Group IA metal, the other of $R_1$ or $R_2$ is not hydrogen or a Group IA metal, and further provided that when either $R_1$ or $R_2$ is phenyl, the other of $R_1$ or $R_2$ is not hydrogen or a Group IA metal.

Thus, the present invention provides an improved peroxide activation process which comprises conjointly incorporating into an aqueous medium (a) a peroxide-activating amount of one or more of the aforementioned cyanoamine compounds, (b) a peroxide-based bleach and (c) a buffering agent to maintain the aqueous medium under alkaline conditions. The present invention also provides stable liquid or solid (dry) peroxide-based bleaching compositions which may be used for bleaching as such, or as a component of a soap or detergent formulation. Alternatively, the peroxide-based bleach and cyanomine activator may be added separately in liquid or solid form to an aqueous medium, together with sufficient buffering agent to maintain the aqueous bleaching/washing medium under alkaline conditions.

In addition to discovering the unique effectiveness of the aforementioned cyanoamine compounds, it has also been found and forms a further embodiment of this invention, that magnesium when used in conjunction with the cyanoamine activators of the present invention substantially enhance (i.e., "boost") the bleaching effectiveness of the cyanoamine activated peroxide-based bleach.

DETAILED DESCRIPTION OF THE INVENTION

Fundamental to this invention is the discovery that certain cyanoamines are surprisingly effective activators for peroxide-based bleaches and in addition have good stability thereby rendering them eminently suitable for use in concentrated bleach compositions and bleach-containing detergent compositions.

The cyanoamine activators which can be suitably employed in the present process and compositions have an equivalent weight of about 44 to about 600 and are represented by the formula:

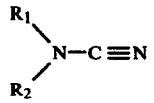

where $R_1$ and $R_2$ taken together with the amino nitrogen to which they are attached form a ring containing 4 to 6 carbon atoms, which carbon atoms may be substituted with a $C_1$–$C_5$ alkyl, $C_1$–$C_5$ alkoxy, $C_1$–$C_5$ alkanoyl, phenyl, middle halogen, amino, amine salt, cyano, or cyanoamino group, or a nitrogen-containing heterocyclic group of 4 to 6 carbon atoms where the nitrogen atom is substituted with a cyano group; or where $R_1$ and $R_2$ taken together with the amino nitrogen to which they are attached are part of a heterocyclic ring of 5 to 7 atoms containing in addition to the indicated nitrogen, one or two additional hetero atoms selected from the group consisting of O, S and N—$R_3$, where $R_3$ is hydrogen or a $C_1$–$C_5$ alkyl, $C_2$–$C_5$ alkenyl, $C_2$–$C_5$ alkynyl, phenyl, $C_7$–$C_9$ aralkyl, $C_5$–$C_7$ cycloalkyl, $C_1$–$C_5$ alkanoyl or cyano group, or another heterocyclic ring of 5 to 7 atoms containing one to three nitrogen atoms substituted with a cyano group, and where the carbon atoms of the first heterocyclic ring or substituent heterocyclic ring can be substituted with a $C_1$–$C_5$ alkyl, $C_1$–$C_5$ alkoxy, $C_1$–$C_5$ alkanoyl, middle halogen, amino, an amine salt, cyano or cyanoamino group; or where $R_1$ and $R_2$ are the same or different and independently represent hydrogen, $C_1$–$C_{20}$ alkyl (straight chain, branched chain or cycloalkyl) $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, $C_7$–$C_{20}$ aralkyl, alkenylcyanoamino or a polyalkenylamino of the type

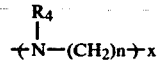

where n=1–2 and x is 1–10 and $R_4$ is H or cyano, a Group IA metal, or any of the foregoing radicals containing a substitutable carbon atom on which is substituted a $C_1$–$C_5$ alkyl, $C_1$–$C_5$ alkoxyl, $C_1$–$C_5$ alkanoyl, middle halogen, amino or an amine salt, cyano, cyanoamino, or hydroxyl group, provided that when either of $R_1$ or $R_2$ is hydrogen or a Group IA metal, the other of $R_1$ or $R_2$ is not hydrogen or a Group IA metal, and further provided that when either $R_1$ or $R_2$ is phenyl, the other of $R_1$ or $R_2$ is not hydrogen or a Group IA metal.

In general when $R_1$ and $R_2$ are separate groups they will have no more than 20 carbon atoms each, preferably no more than 12 carbon atoms each. While the cyanoamine activators in accordance with the invention may contain a variety of different substituent groups as mentioned above, it is important that the substituent group(s) not be such as to deleteriously affect the overall bleach system. Thus, while the cyanoamine activators in accordance with the invention may contain substituent groups such as middle halogen (i.e., chloro and bromo), amino or amine salt (i.e., the organic or inorganic salt of a basic amino group) cyano, alkoxy, hydroxyalkyl, etc., they should not contain a chromophore group or chromophore precursor such as azo, diazo or quinone groups, or groups readily oxidizable by hydrogen peroxide, or an acid-containing group which would lower the pH of the bleach system below 7. While as stated above, the equivalent weight of the cyanoamine activator can vary from about 44 to about 600, preferably the equivalent weight will be from 44 to 200.

Examples of especially useful classes of cyanoamines falling within the ambit of the above depicted structural formula include the following:

(1) N-cyanomonoalkylamines such as N-cyanomethylamine, N-cyanoethylamine, N-cyanoisopropylamine, N-cyanopropenylamine, N-cyanopropynylamine, N-cyano-n-butylamine and N-cyano-n-hexylamine, N-cyanolaurylamine and N-cyanostearylamine, (2) N-cyanodialkylamines such as N-cyanodimethylamine, N-cyanodiethylamine, N-cyanodiallylamine, N-cyanodiisobutylamine, N-cyanodi-n-butylamine and N-cyanoethylpropylamine, N-cyanomethyllaurylamine, (3) N-cyanomonocycloalkylamines such as N-cyanocyclopentylamine and N-cyanocyclohexylamine, (4) N-cyanomonoheterocyclicamines such as N-cyanopyrrolidine, N-cyanomorpholine, N-cyanopiperidine, N-cyano-N'-methylpiperazine, N,N',N''-tricyanohexahydrotriazine, and N,N'-dicyanopiperazine, (5) N-cyanoaralkylamines such as N-cyanobenzylamine, (6) N-cyanoarylalkylamines such as N-cyano-N-methylphenylamine and N-cyano-N-methylbenzylamine, (7) N-cyano-N-(alkoxyaralkyl)amine such as N-cyano-p-methoxybenzylamine, and (8) Group IA metal salts of classes (1), (3), (5) and (7), such as the sodium, potassium or lithium salts of N-cyano-n-butylamine, N-cyanocyclohexylamine, N-cyanobenzylamine and N-cyano-p-methoxybenzylamine, (9) N,N'-dicyanoalkenyldiamines such as N,N'-dicyanotetramethylenediamine, N,N'-dicyano-1,6-hexamethylenediamine,

(10) Cyano-substituted polyalkenylamines, especially cyano substituted polyethyleneamines, such as N,N',N''-tricyanodiethylenetriamine and hexacyanopentaethylenedhexaamine,

(11) Cyano-substituted cycloalkylpolyamines, especially dicyano-substituted $C_5$–$C_7$ cycloalkyldiamines, such as N,N'-dicyano-1,2-cyclohexyldiamine,

(12) N,N'-dicyanodicycloalkyldiamines, especially N,N'-dicyanodi-$C_5$-$C_7$-cycloalkyldiamines, such as N,N'-dicyanodicyclohexyldiamine and bis(4-cyanoaminocyclohexyl)methane,

(13) N,N'-dicyanodiheterocyclicdiamines, especially compounds of this type having 5 to 7 membered heterocyclic rings and in which the only hetero atoms are nitrogen, such as N,N'-dicyanodipiperidine and bis[4-(N-cyano)piperidino]methane

(14) N,N'-dicyanoheterocycliccycloalkylamines, especially N,N'-dicyanoheterocyclic $C_5$–$C_7$ cycloalkylamines such as N,N'-dicyanopiperidinocyclohexylamine and N,N'-dicyanopiperazinocyclohexylamine,

(15) Cyano-substituted amideamines such as N,N',N''-tricyanodiethylenetriamine acetamide, and

(16) N,N'-dicyanopolyalkoxydiamines such as N,N',-dicyanotetraethoxydiamine and N,N'-dicyanotetrapropoxydiamine.

Of the foregoing classes (1) through (8) have been found to be very useful, with the N-cyanomonoheterocyclicamines being preferred because of their excellent activating effect on peroxide-based bleaches. Especially preferred are N-cyanomonoheterocyclicamines having 5 or 6 membered rings and having oxygen and/or nitrogen as the only hetero-atoms. Particularly preferred members of this class are N-cyanomorpholine, N-cyanopiperidine and N,N'-dicyanopiperazine, all of which have outstanding peroxide-activating properties as well as good stability.

Methods for preparing cyanoamines of the type employed in the present invention are well known in the art. A suitable method involves the reaction of the appropriate amine with a cyanogen halide in the presence of a hydrogen halide accepting base. For example, the reaction of an appropriate amine with cyanogen bromide or cyanogen chloride in the presence of a hydrogen halide accepting base such as sodium hydroxide, sodium carbonate, or excess amine will form the corresponding N-cyanoamine.

The aforementioned cyanoamine activators are employed in accordance with the invention to activate any of a variety of peroxide-based bleaches. By "peroxide-based bleach", as this term is used in this specification and claims, is meant hydrogen peroxide and any other compound which releases hydrogen peroxide (i.e., perhydroxy ion) in aqueous solution. Such compounds include, for example, perborates, percarbonates, peracids, urea peroxide and ketone peroxides. These types of peroxy compounds and there manner of preparation are known in the art, and are described, for example in Kirk-Othmer, Encyclopedia of Chemical Technology, 2nd ed., Vol. 14, pp. 757–760. Of the various peroxide-based bleaches which can be suitably employed in accordance with the invention, hydrogen peroxide, perborates, and percarbonates are preferred. Particularly preferred among the perborates are the sodium perborates, especially sodium perborate tetrahydrate because of its commercial availability. However, sodium perborate monohydrate ($NaBO_3.H_2O$) is especially suitable in bleach compositions where package stability under adverse storage conditions is desired.

The mechanism by which the N-cyanoamines of the invention serve to activate peroxide-based bleaches is not precisely known. However, it has been found that particularly effective levels of bleaching are achieved if the aqueous medium in which the bleaching and/or washing is accomplished (e.g., a washing machine in the case of home laundering) is maintained under alkaline conditions, e.g., at a pH of 7 or greater. Buffering of the bleaching/washing medium to the desired pH can be accomplished by adding an alkali and/or an alkaline buffering agent to be bleaching/washing medium prior to, concurrently with, or after the addition of the N-cyanoamine and peroxide-based bleach. A convenient means of accomplishing buffering in the case of laundering application is by the use of detergents which commonly contain alkaline buffering agents. The cyanoamine activators themselves frequently contribute to the alkalinity of the aqueous bleaching medium, as do certain peroxide-based bleaches, e.g., perborates and percarbonates. Hence, in many cases little or no additional buffering agent (other than the cyanoamine and peroxide-based bleach) will be required to maintain the pH of the aqueous medium under alkaline conditions. However, additional buffering agents can be added if higher levels of alkalinity are desired.

The amount of peroxide-based bleach employed in accordance with the invention will vary widely depending on the material to be bleached, the extent of bleaching desired, and the bleaching conditions. In general, the amounts of peroxide-based bleach, calculated as hydrogen peroxide, in bleach compositions will range from about 1 to about 35 percent by weight (%w) of the total composition, preferably from about 2 to about 15%w. Higher peroxide concentrations could be used but generally would not, because of the reactivity of highly concentrated peroxide solutions with organic material which could result in detonable mixtures. In the embodiment of the present invention where the peroxide-based bleach and cyanoamine activator are incorporated into a conventional built laundry detergent composition, a lower concentration of peroxide-based bleach (e.g., from 0.1 to 8%w, calculated as hydrogen peroxide) is usually employed together with an activating amount of the cyanoamine activator. The major ingredients in such detergent compositions will generally comprise a synthetic detergent and an alkaline detergent builder.

To effect bleaching, the cyanoamine activated peroxide-based bleach compositions of the invention are generally added to the aqueous medium in an amount that will result in 2 to 600 millimoles/liter (mmoles/l) of the peroxide-based bleach, calculated as hydrogen peroxide, being present in the aqueous medium. The precise peroxide-based bleach concentration selected will vary depending on the nature of the substance being bleached and the degree of bleaching desired.

For home and commercial laundry applications, the concentration of peroxide-based bleach in present compositions would suitably be such that the concentration of peroxide-based bleach, calculated as hydrogen peroxide, in the wash water will be on the order of 2 to 12 mmoles/l. As would be apparent to those skilled in the art, the foregoing concentrations could be varied if greater or lesser bleaching is desired.

Insofar as the proportions of cyanoamine activator to the peroxide-based bleach are concerned, all that is required for purposes of the present invention is that a sufficient amount of cyanoamine activator be present in the composition to activate the peroxide-based bleach upon addition to an alkaline aqueous bleaching/washing medium. Generally, the molar ratio of cyanoamine activator to the peroxide-based bleach will be on the order of from 1:20 to 20:1, with preferred ratios being from about 1:1 to about 1:10.

The present concentrated bleach compositions can be in either liquid or solid form. If prepared in liquid form (e.g., an aqueous hydrogen peroxide solution containing a cyanoamine activator), it is important that pH of the bleach composition be maintained at a relatively low pH until the product is ready for use to avoid premature reaction and/or decomposition of the hydrogen peroxide (i.e., hydrogen peroxide may decompose by either free radical or ionic reactions which in general proceed more rapidly at higher pH values). A stable (i.e., inactive or non-reactive) cyanoamine activated peroxide-based bleach composition can be obtained by maintaining the pH of such composition at a value below 5, preferably at a pH of from 2 to 5, most preferably at a pH of about 4, until the composition is ready for use. The composition can readily be converted to an "active state" by adjusting the pH to above 7 at their time of use by addition of alkali and/or alkaline buffering agent and/or alkaline detergent to the aqueous bleaching-/washing medium, as previously discussed.

If desired, the hydrogen peroxide and cyanoamine activator can be packaged in separate containers and the two components added separately to the aqueous bleaching/washing medium just prior to use. In this manner premature reaction between the cyanoamine activator and hydrogen peroxide can also be avoided. However, even if packaged separately, it is still generally desirable that the hydrogen peroxide solution be maintained at a low pH until use in order to avoid decomposition of the peroxide as previously discussed.

Concentrated solid bleach formulations in accordance with the invention will generally comprise a solid peroxide-based bleach (e.g., sodium perborate monohydrate) and a cyanoamine activator therefore and suitable alkaline buffering agents, fillers and/or desiccants. In cases where the cyanoamine activator is a liquid at room temperature, the activator may be formulated as a solid composition by intimately mixing the liquid cyanoamine with an inert solid carrier such as talcum, diatomaceous earth, various clays, etc. An advantage of a concentrated solid bleach formulation over a concentrated liquid formulation is that the pH of the solid formulation need not be maintained at a low level while in storage because solid compositions are inherently stable so long as they are not contaminated with moisture. Such contamination can be avoided through the use of desiccants and/or by encapsulating the cyanoamine activator and/or the solid peroxide-based bleach in accordance with well known procedures.

In general, any encapsulating technique which provides a covering for the cyanoamine activator and/or peroxide-based bleach particles to prevent their coming into direct contact until they are added to the aqueous bleaching medium can be suitably employed in the practice of this invention. Thus, the function of the covering material (encapsulating agent) is to prevent premature reaction or decomposition of the cyanoamine activator and peroxide-based bleach while in storage, yet effectively release the activator and/or peroxide-based bleach upon addition to the aqueous medium.

Suitable encapsulating agents include both water soluble and water dispersible substances such as stearic acid, polyethyleneglycols, condensation products of alcohols and ethyleneoxide and/or propyleneoxide (e.g., alcohol ethoxylates or propoxylates or combinations thereof), polyvinyl alcohol, carboxymethylcellulose, cetyl alcohol, fatty acid alkanolamides and the like. Encapsulation may be conveniently accomplished by dissolving the encapsulating agent in a volatile organic solvent and spraying the finely divided particles of cyanoamine activator and/or peroxide-based bleach with the solution after which the sprayed particles are dried. Such a procedure is described, for example, in U.S. Pat. No. 3,163,606. Other suitable encapsulation techniques are described in U.K. Pat. No. 1,395,006.

The present compositions can be employed over a relatively wide range of temperatures, e.g., from about 45° F. up to the boiling point of water (212° F.). However, it can most advantageously be employed at temperatures of 60° to 160° F., which encompasses typical temperatures of home laundering in the United States. As previously stated, a substantial improvement in bleaching effectiveness is obtained by use of the present compositions as compared to the use of peroxide-based bleaches alone, or peroxide-based bleaches activated with prior art activators.

The cyanoamine-activated bleaching compositions of the present invention can be employed to bleach any of a wide variety of bleachable substances including textiles, wood and wood products, surfactants, leather, hair and any other substance commonly bleached with peroxide-based bleaches. The present compositions are especially suitable for use in home and commercial laundering applications, wherein unactivated peroxide-based bleaches are largely ineffectual because of the relatively short wash cycles and lower temperatures involved, particularly in the United States. The compositions of the invention are effective in bleaching stains from a wide variety of fabrics, including those manufactured from natural as well as synthetic fibers. They are particularly effective for washing cotton goods and goods produced from synthetic fibers, and are advantageous over chlorine-based bleaches in that they do not cause yellowing of fabrics even after repeated washings. In addition, the compositions of the present invention would be expected to cause considerably less loss in strength of fibers than do chlorine-based bleaches, and are also safer to use on colored materials.

The activated bleaching compositions of the invention may generally also be used for their germicidal properties in various applications, for example, as a disinfectant for use in the home, e.g., in kitchens, bathrooms, etc., for institutional use, for water treatment and the treatment of swimming pools, etc.

In the case of home or commercial laundering, the activated bleaching compositions of the present invention will normally be employed in conjunction with a soap or detergent, which may be provided as a part of the bleach/washing composition, or may be added separately to the wash liquor. In general, any commonly used soap may be employed for this purpose, for example, alkali metal salts of fatty acids, such as stearic and/or palmitic acids, or of rosin acids. Synthetic detergents which can be used with or without such soaps include the anionic, cationic, zwitterionic, ampholytic, non-ionic and semi-polar organic surface-active agents. Typical anionic detergents which can be employed in the practice of the present invention include various sulfates and sulfonates, such as alkyl aryl sulfonates, alkyl sulfonates, sulfates of fatty acid monoglycerides, olefin sulfonates, sulfonated fatty acids and esters, alkyl glyceryl ether sulfonates, fatty isethionates, and the like, having aliphatic hydrocarbon chains of about 10 to about 20 carbon atoms, and alkyl sulfate, alkyl polyether sulfate and alkyl phenol polyether sulfate salts such as sodium lauryl sulfate, sodium alkyl phenol polyether sulfates and mixed secondary alkyl sulfate alkali metal salts of 8 to 18 carbon atoms per molecule. Examples of non-ionic surface active agents which can be used in the practice of the invention are the saponines, fatty alkanolamides, amine oxides and ethylene oxide condensation products with fatty acids, alcohols, polypropylene glycols, alkyl phenols, esters, and the like, especially those with alkyl chains of 8 to 20 carbon atoms and 3 to 20 glycol units per molecule. Examples of typically suitable cationic surface active agents include those based on diamines, e.g., N-aminoethyl stearylamine and N-aminoethyl myristylamine; amide-linked amines, e.g., N-aminoethylstearylamide and N-aminoethyl myristylamide; quaternary ammonium compounds containing at least one long chain alkyl group attached to the nitrogen atom, e.g., ethyl-dimethylstearyl ammonium chloride and dimethyl-propylmyristyl ammonium chloride; and the like.

Any of the builders or other additives conventionally employed in bleach or detergent products can be used in the bleaching compositions of the invention. These include, for example, alkaline materials such as alkali metal hydroxides, phosphates (including orthophosphates, tripolyphosphates and pyrophosphates), carbonates, bicarbonates, citrates, polycarboxylates, borates, silicates and aluminosilicates, also alkanolamines and ammonia. Inert compounds such as alkali metal sulfates or chlorides can also be employed.

Other additives which may optionally be incorporated in or used in conjunction with the instant compositions, include fabric softeners, germicides, fungicides, enzymes, anti-redeposition agents, flocculants, optical brighteners, colorants, perfumes, thickeners, stabilizers, suds builders or suds depressants, anti-corrosion agents, fluorescent agents and the like.

As previously mentioned, in a further embodiment of the present invention magnesium is used in conjunction with the cyanoamine activator to further enhance the effectiveness of the peroxide-based bleach. In the practice of this embodiment magnesium is normally incorporated into the cyanoamine-activated peroxide-based system as a metal oxide or a metal salt, although any compounds which generate magnesium ions can be employed. Illustrative of the metal salts which can be suitably employed to introduce magnesium into the bleach system are magnesium hydroxide, magnesium chloride, magnesium sulfate, magnesium nitrate, magnesium citrate and the like. Magnesium salts of ethylenediaminetetraacetic acid and its homologs are also very suitable. Because of its commercial availability, magnesium sulfate is an especially preferred magnesium salt.

Magnesium can be incorporated into the cyanoamine-activated peroxide bleach system as part of the concentrated bleach formulation (either liquid or solid) or as part of a bleach-containing detergent composition, or it may be added as a separate component to the aqueous bleaching/washing medium.

The concentration of magnesium employed in the practice of this embodiment of the invention can vary over a relatively broad range. However, in general, the molar ratio of magnesium to the peroxide-based bleach will range from about 1:60 to about 25:1. Preferred magnesium to peroxide-based bleach molar ratios are from about 1:1 to about 1:10. For home laundry applications the concentration of magnesium in the wash water will generally range from about 0.1 to about 6 mmoles/l. Higher magnesium concentrations could be employed but generally would not because of the adverse effects such higher concentrations might have on detergency.

The present invention and its benefits are further described in the following examples, which are intended only to be illustrative of the invention, and should not be construed as limiting.

EXAMPLES 1-11—PREPARATION OF BLEACH ACTIVATORS

A number of cyanoamine peroxide bleach activators in accordance with the invention were prepared by reacting various amines with cyanogen bromide according to the following general procedure. Stoichiometric quantities of cyanogen bromide dissolved in benzene (or ethyl acetate in case of more polar amines) were added slowly over several hours at ambient temperatures to well-stirred solutions of the appropriate amines in benzene. The amine-salt precipitates were separated by vacuum filtration. After washing the filter cakes with benzene, the filtrate was concentrated on a steam bath and the desired cyanoamines were recovered and purified by standard crystallization procedures.

The peroxide-bleach activators prepared utilizing this procedure include the following:

| Ex. No. | Amine Used | Bleach Activator |
|---|---|---|
| 1 | morpholine | N-cyanomorpholine |
| 2 | piperidine | N-cyanopiperidine |
| 3 | cyclohexylamine | N-cyanocyclohexylamine |
| 4 | N-methylphenylamine | N-cyano-N-methylphenylamine |
| 5 | benzylamine | N-cyanobenzylamine |
| 6 | N-methylbenzylamine | N-cyano-N-methylbenzylamine |
| 7 | piperazine | N,N'-dicyanopiperazine |
| 8 | p-methoxybenzylamine | N-cyano-p-methoxybenzylamine |
| 9 | di-n-butylamine | N-cyano-di-n-butylamine |

Further cyanoamine peroxide bleach activators in accordance with the invention were prepared by replacing a hydrogen atom attached to the amino nitrogen atom with a Group IA metal according to the following general procedure. The cyanoamines were dissolved in concentrated sodium hydroxide solution. The sodium salts were "salted-out" into isopropyl alcohol using ammonium carbonate. After separation, the alcohol layer was concentrated on a steam bath and the sodium cyanoamines were recovered and purified by standard crystallization procedures. Utilizing this procedure the following activators were were prepared:

| Example No. | Bleach Activator |
|---|---|
| 10 | N-cyanocylohexylamine, sodium salt |

-continued

| Example No. | Bleach Activator |
|---|---|
| 11 | N-cyanobenzylamine, sodium salt |

EXAMPLES 12–41—Evaluation of Bleach Activators

The cyanoamine compounds of Examples 1 to 11 were evaluated as bleach activators utilizing the general test procedure outlined below. A prior art activator and several structurally related cyanoamines not in accordance with the invention were included in these evaluation tests for comparative purposes.

Five hundred (500) ml of deionized water was added to a U.S. Testing, Inc. Terg-O-Tometer bath maintained at 120° F. The pH of the water in the bath was adjusted to the values shown in Table I by the addition of sodium carbonate as the alkaline buffering agent. The peroxide-based bleach and peroxide activator were added to the wash water and the water agitated to avoid localized concentrations of any one additive. Finally, four swatches, measuring 4"×4", of EMPA 115 cloth (a standard cotton bleach test cloth soiled with sulfur black dye) were introduced into the wash water and the agitator run for 10 and 20 minutes, respectively, at 100 rpm. At the conclusion of each wash period, two swatches were removed and rinsed by squeezing under a tap. The test cloths were then dried and the reflectance values measured on a Gardner Reflectometer, Model XL-23, utilizing the Y scale. The change that occurred as a result of the bleach/wash cycle was reported as the change in percent reflectance value (ΔR), which equals the difference between the reflectance of the swatch after bleaching and the reflectance of the same swatch before bleaching. Thus the larger the ΔR value, the more effective the bleaching action.

The various activators tested and the results obtained are presented in Table I. The peroxide-based bleach employed in each of these tests was sodium perborate monohydrate. The concentration of the peroxide-based bleach in each of the examples was 8 mmoles/liter. The concentration of activator in Examples 12–29 and 31–41 was 4 mmoles/liter, while the activator concentration in Example 30 was 2 mmoles/liter.

TABLE I

| Ex. No. | Activator | pH | Δ R Wash Cycle 10 mins | 20 mins |
|---|---|---|---|---|
| 12 | N-cyanomorpholine | 10 | 8.1 | 10.0 |
| 13 | N-cyanomorpholine | 10.5 | 12.5 | 13.8 |
| 14 | N-cyanopiperidine | 10 | 12.6 | 10.0 |
| 15 | N-cyanopiperidine | 10.5 | 13.0 | 15.7 |
| 16 | N-cyanocyclohexylamine | 10 | 9.0 | 12.1 |
| 17 | N-cyanocyclohexylamine | 10.5 | 15.5 | 19.0 |
| 18 | N-cyanocyclohexylamine, Na salt | 10 | 9.8[a] | 13.2[a] |
| 19 | N-cyanocyclohexylamine, Na salt | 10.5 | 16.3 | 18.9 |
| 20 | N-cyanodi-n-butylamine | 10 | 4.8[b] | 7.6[b] |
| 21 | N-cyanodi-n-butylamine | 10.5 | 10.9 | 15.8 |
| 22 | N-cyano-N-methylphenylamine | 10 | 6.9[a] | 9.6 |
| 23 | N-cyano-N-methylphenylamine | 10.5 | 12.1 | 14.9 |
| 24 | N-cyanobenzylamine | 10 | 11.5 | 13.4 |
| 25 | N-cyanobenzylamine | 10.5 | 12.7 | 15.0 |
| 26 | N-cyanobenzylamine, Na salt | 10 | 12.0 | 14.5 |
| 27 | N-cyanobenzylamine, Na salt | 10.5 | 12.9 | 14.7 |
| 28 | N-cyano-N-methylbenzylamine | 10 | 13.7 | 17.2 |
| 29 | N-cyano-N-methylbenzylamine | 10.5 | 16.7 | 20.2 |
| 30 | N,N'-dicyanopiperazine | 10 | 15.0 | 16.1 |
| 31 | N-cyano-n-hexylamine | 10 | 14.7 | 16.6 |
| 32 | N-cyano-n-hexylamine | 10.5 | 13.0 | 14.4 |
| 33 | N-cyano-p-methoxybenzylamine | 10 | 22.5 | 24.2 |
| 34 | N-cyano-p-methoxybenzylamine | 10.5 | 20.8 | 25.9 |

TABLE I-continued

| Ex. No. | Activator | pH | Δ R Wash Cycle 10 mins | 20 mins |
|---|---|---|---|---|
| 35 | dicyandiamide | 10 | 1.3 | 2.3 |
| 36 | dicyandiamide | 10.5 | 1.9 | 2.1 |
| 37 | sodium dicyanamide | 10 | 0.9 | 1.4 |
| 38 | N-cyanophenylamine | 10 | 1.9 | 2.8 |
| 39 | N-cyanophenylamine | 10.5 | 2.1 | 3.2 |
| 40 | sodium acid cyanamide | 10 | 4.6[a] | 6.4[a] |
| 41 | sodium acid cyanamide | 10.5 | 6.6 | 9.2 |

[a]Average of two determinations
[b]Average of three determinations

The foregoing results indicate that the cyanoamine bleach activators in accordance with the invention (Examples 12–34) are highly effective peroxide-based bleach activators, while other cyanoamine compounds having closely related chemical structures (Examples 35–39) are not. The data further demonstrate that the present cyanoamine activators as a class are superior to such prior art activators as sodium acid cyanamide, which is very effective activator in its own right.

EXAMPLES 42–71—Evaluation of Bleach Activators Additionally Containing Magnesium The following examples demonstrate a preferred amendment of the present invention in which a magnesium compound is employed in conjunction with the cyanoamine activators of the invention to further enhance the bleaching effectiveness of the peroxide-based bleach. The same test procedure was employed as in Examples 12–41, and as in the previous examples, a certain prior art activator and structurally related compounds not in accordance with the invention were tested for comparative purposes. The results of these tests are summarized in the following table. The same type and concentration of peroxide-based bleach was employed in these examples as in Examples 12–41. The concentration of activator in each of the tests was 4 mmoles/liter, except for Example 60 in which an activator concentration of 2 mmoles/liter was employed. The magnesium concentration in each examples was 4 mmoles/liter and was added as $MgSO_4.7H_2O$.

TABLE II

| Ex. No. | Activator | pH | ΔR Wash Cycle 10 mins | 20 mins |
|---|---|---|---|---|
| 42 | N-cyanomorpholine | 10 | 46.6 | 46.7 |
| 43 | N-cyanomorpholine | 10.5 | 45.9 | 47.7 |
| 44 | N-cyanopiperidine | 10 | 44.5 | 47.5 |
| 45 | N-cyanopiperidine | 10.5 | 47.8 | 51.5 |
| 46 | N-cyanocyclohexylamine | 10 | 39.9 | 42.8 |
| 47 | N-cyanocyclohexylamine | 10.5 | 42.1 | 44.6 |
| 48 | N-cyanocyclohexylamine, Na salt | 10 | 40.3 | 43.4 |
| 49 | N-cyanocyclohexylamine, Na salt | 10.5 | 42.2 | 43.4 |
| 50 | N-cyano-di-n-butylamine | 10 | 21.1[a] | 35.7[a] |
| 51 | N-cyano-di-n-butylamine | 10.5 | 30.8 | 43.7 |
| 52 | N-cyano-N-methylphenylamine | 10 | 40.7 | 47.5 |
| 53 | N-cyano-N-methylphenylamine | 10.5 | 45.5 | 48.8 |
| 54 | N-cyanobenzylamine | 10 | 39.4 | 41.1 |
| 55 | N-cyanobenzylamine | 10.5 | 40.8 | 41.8 |
| 56 | N-cyanobenzylamine, Na salt | 10 | 38.9 | 38.2 |
| 57 | N-cyanobenzylamine, Na salt | 10.5 | 40.8 | 41.8 |
| 58 | N-cyano-N-methylbenzylamine | 10 | 44.6 | 48.7 |
| 59 | N-cyano-N-methylbenzylamine | 10.5 | 48.4 | 50.5 |
| 60 | N,N'-dicyanopiperazine | 10 | 50.3[b] | 51.4[b] |
| 61 | N-cyano-n-hexylamine | 10 | 43.3 | 46.8 |
| 62 | N-cyano-n-hexylamine | 10.5 | 42.6 | 45.2 |
| 63 | N-cyano-p-methoxybenzylamine | 10 | 46.3 | 47.6 |
| 64 | N-cyano-p-methoxybenzylamine | 10.5 | 44.1 | 45.5 |
| 65 | dicyandiamide | 10 | 1.4 | 2.8 |

TABLE II-continued

| Ex. No. | Activator | pH | ΔR Wash Cycle 10 mins | 20 mins |
|---|---|---|---|---|
| 66 | dicyandiamide | 10.5 | 1.3 | 3.3 |
| 67 | sodium dicyanamide | 10 | 0.9 | 1.4 |
| 68 | N-cyanophenylamine | 10 | 1.5 | 2.1 |
| 69 | N-cyanophenylamine | 10.5 | 1.4 | 2.4 |
| 70 | sodium acid cyanamide | 10 | 32.2 | 40.5 |
| 71 | sodium acid cyanamide | 10.5 | 30.6 | 38.1 |

[a]Average of four determinations
[b]Average of two determinations

From the above data it can be seen that extremely high levels of bleaching can be achieved by inclusion of magnesium into the cyanoamine activated peroxide-based bleach systems in accordance with the invention.

EXAMPLE 72—Evaluation of Stability of Bleach Activators

In this example a preferred cyanoamine activator in accordance with the invention, N,N'-dicyanopiperazine, was evaluated for storage stability both in the neat state and in a fully formulated bleach product. The test involved spreading samples of the neat activator and formulated product in a thin layer (i.e., about 1/16") on petri dishes which were placed in an oven at 50° C. with the relative humidity controlled at 50%. Portions of the samples of the neat activator and formulated product were periodically removed from the oven and tested for bleaching effectiveness in accordance with the previously described test procedure. The fully formulated product (Sample A in Table III) was taken from the oven and tested as is, while the neat activator (Sample B in Table III) was mixed with the other components of the formulation at the time of testing. The composition of the formulation and the results obtained were as follows:

Sample A (fully formulated product)
- 8.0%w N,N'-dicyanopiperazine
- 25.0%w sodium perborate monohydrate
- 14.0%w magnesium sulfate (anhydrous)
- 53.0% sodium carbonate (anhydrous)

Sample B
- (8%w neat N,N'-dicyanopiperazine from oven added to balance of formulation of Sample A).

TABLE III

| Days in Storage | Stability at 50° C./50% Relative Humidity: pH 10.0–10.1 | Δ R - Index[a] Sample A | Sample B |
|---|---|---|---|
| 0 | | 38 | 53 |
| 4.0 | | — | 53 |
| 7.0 | | 42 | — |
| 12.0 | | — | 53 |
| 14.9 | | 37 | — |
| 19.8 | | — | 52 |
| 23.9 | | 34 | — |
| 28.8 | | — | 51 |
| 30.9 | | 24 | — |
| 35.8 | | — | 48 |
| 42.8 | | — | 54 |

[a]Average of Δ R obtained at 10, 20 and 30 minute wash cycles.

The foregoing data indicate that the cyanoamine activator in accordance with the invention has excellent stability under the severe conditions of this test. In fact this activator is sufficiently stable that encapsulating, which is a necessity in the case of many prior art activators, would not be required, thereby offering a significant advantage from a formulation standpoint.

It is to be understood that the foregoing detailed description of the invention is merely given by way of illustration, and that many variations may be made without departing from the spirit and scope of the invention.

What is claimed:

1. A process for activating a peroxide-based bleach which comprises conjointly incorporating into an aqueous medium (a) a peroxide-activating amount of a cyanoamine having an equivalent weight of about 44 to about 600 and represented by the formula:

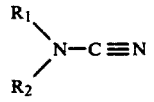

where $R_1$ and $R_2$ taken together with the amino nitrogen to which they are attached form a ring containing 4 to 6 carbon atoms, which carbon atoms may be substituted with a $C_1$–$C_5$ alkyl, $C_1$–$C_5$ alkoxy, $C_1$–$C_5$ alkanoyl, phenyl, middle halogen, amino, amine salt, cyano or cyanoamino group, or with a nitrogen-containing heterocyclic group of 4 to 6 carbon atoms where the nitrogen atom is substituted with a cyano group, or where $R_1$ and $R_2$ taken together with the amino nitrogen to which they are attached are part of a heterocyclic ring of 5 to 7 atoms containing in addition to the indicated nitrogen, one or two additional hetero atoms selected from the group consisting of O, S and N—$R_3$, where $R_3$ is hydrogen or a $C_1$–$C_5$ alkyl, $C_2$–$C_5$ alkenyl, $C_2$–$C_5$ alkynyl, phenyl, $C_7$–$C_9$ aralkyl, $C_5$–$C_7$ cycloalkyl, $C_1$–$C_5$ alkanoyl or cyano group, or another heterocyclic ring of 5 to 7 atoms containing one to three nitrogen atoms substituted with a cyano group, and where the carbon atoms of the first heterocyclic ring or substituent heterocyclic ring can be substituted with a $C_1$–$C_5$ alkyl, $C_1$–$C_5$ alkoxy, $C_1$–$C_5$ alkanoyl, middle halogen, amino, amine salt, cyano or cyanoamino group; or where $R_1$ and $R_2$ are the same or different and independently represent hydrogen, $C_1$–$C_{20}$ alkyl (straight chain, branched chain or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, $C_7$–$C_{20}$ aralkyl, alkenylcyanoamino or a polyalkenylamino of the type

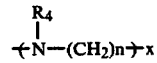

where n=1–2 and x is 1–10 and $R_4$ is H or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or an amine salt, cyano, cyanoamino or hydroxyl group, provided that when either of $R_1$ or $R_2$ is hydrogen or a Group IA metal, the other of $R_1$ or $R_2$ is not hydrogen or a Group IA metal, and further provided that when either $R_1$ or $R_2$ is phenyl, the other of $R_1$ or $R_2$ is not hydrogen or a Group IA metal, (b) a peroxide-based bleach and (c) a buffering agent to maintain the aqueous medium under alkaline conditions.

2. The process of claim 1 wherein the peroxide-based bleach is hydrogen peroxide, sodium perborate or sodium percarbonate.

3. The process of claim 1 wherein the cyanoamine peroxide activator has an equivalent weight of about 44 to about 200.

4. The process of claim 3 wherein $R_1$ and $R_2$ together with the amino nitrogen to which they are attached represent morpholine, piperidine or N'-cyanopiperazine.

5. The process of claim 3 wherein a magnesium compound is additionally incorporated into the aqueous medium.

6. The process of claim 1 wherein the cyanoamine activator is a (1) N-cyanomonoalkylamine, (2) N-cyanodialkylamine, (3) N-cyanomonocycloalkylamine, (4) N-cyanomonoheterocyclicamine, (5) N-cyano-N-aralkylamine, (6) N-cyano-N-arylalkylamine, (7) N-cyano-N-(alkoxyaralkyl)amine or (8) a Group IA metal salt of (1), (3), (5) or (7).

7. The process of claim 5 wherein the magnesium compound is a magnesium salt or oxide.

8. The process of claim 1 wherein the cyanoamine is N,N'-dicyanopiperazine.

9. A stable concentrated bleaching composition consisting essentially of (a) from 1 to 35% by weight, calculated as hydrogen peroxide, of the total composition of a peroxide-based bleach, (b) a peroxide activating amount of a cyanoamine having an equivalent weight of about 44 to about 600 and represented by the formula:

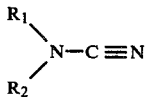

where $R_1$ and $R_2$ taken together with the amino nitrogen to which they are attached form a ring containing 4 to 6 carbon atoms, which carbon atoms may be substituted with a $C_1$–$C_5$ alkyl, $C_1$–$C_5$ alkoxy, $C_1$–$C_5$ alkanoyl, phenyl, middle halogen, amino, amine salt, cyano or cyanoamino group, or with a nitrogen-containing heterocyclic group of 4 to 6 carbon atoms where the nitrogen atom is substituted with a cyano group, or where $R_1$ and $R_2$ taken together with the amino nitrogen to which they are attached are part of a heterocyclic ring of 5 to 7 atoms containing in addition to the indicated nitrogen, one or two additional hetero atoms selected from the group consisting of O, S and N—$R_3$, where $R_3$ is hydrogen or a $C_1$–$C_5$ alkyl, $C_2$–$C_5$ alkenyl, $C_2$–$C_5$ alkynyl, phenyl, $C_7$–$C_9$ aralkyl, $C_5$–$C_7$ cycloalkyl, $C_1$–$C_5$ alkanoyl or cyano group, or another heterocyclic ring of 5 to 7 atoms containing one to three nitrogen atoms substituted with a cyano group, and where the carbon atoms of the first heterocyclic ring or substituent heterocyclic ring can be substituted with a $C_1$–$C_5$ alkyl, $C_1$–$C_5$ alkoxy, $C_1$–$C_5$ alkanoyl, middle halogen, amino, amine salt, cyano or cyanoamino group; or where $R_1$ and $R_2$ are the same or different and independently represent hydrogen, $C_1$–$C_{20}$ alkyl (straight chain, branched chain or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, $C_7$–$C_{20}$ aralkyl, alkenylcyanoamino or a polyalkenylamino of the type

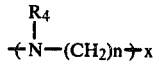

where n=1–2 and x is 1–10 and $R_4$ is H or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or amine salt, cyano, cyanoamino, or hydroxyl group, provided that when either of $R_1$ or $R_2$ is hydrogen or a Group IA metal, the other of $R_1$ or $R_2$ is not hydrogen or a Group IA metal, and further provided that when either $R_1$ or $R_2$ is phenyl, the other of $R_1$ or $R_2$ is not hydrogen or a Group IA metal, (c) a buffering agent to maintain the aqueous medium under alkaline conditions.

10. The composition of claim 9 wherein the molar ratio of the cyanoamine peroxide activator to the peroxide-based bleach is 1:20 to 20:1.

11. The composition of claim 9 wherein the peroxide-based bleach is hydrogen peroxide, sodium perborate or sodium percarbonate.

12. The composition of claim 10 wherein the cyanoamine peroxide activator has an equivalent weight of about 44 to about 200.

13. The composition of claim 9 which additionally contains a magnesium compound.

14. The composition of claim 11 wherein $R_1$ and $R_2$ together with the amino nitrogen to which they are attached represent morpholine, piperidine or N'-cyanopiperazine.

15. The composition of claim 13 wherein the magnesium compound is a magnesium salt or oxide.

16. The composition of claim 9 wherein the cyanoamine is N,N'-dicyanopiperazine or N-cyanopiperidine.

17. The composition of claim 9 wherein the peroxide-based bleach and cyanoamine activator therefor are encapsulated.

18. A bleaching/washing composition consisting essentially of an aqueous medium containing (a) from 2 to about 600 millimoles/liter of a peroxide-based bleach, (b) a peroxide-activating amount of a cyanoamine having an equivalent weight of about 44 to about 600 and represented by the formula:

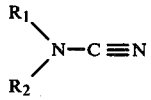

where $R_1$ and $R_2$ taken together with the amino nitrogen to which they are attached form a ring containing 4 to 6 carbon atoms, which carbon atoms may be substituted with a $C_1$–$C_5$ alkyl, $C_1$–$C_5$ alkoxy, $C_1$–$C_5$ alkanoyl, phenyl, middle halogen, amino, amine salt, cyano or cyanoamino group, or with a nitrogen-containing heterocyclic group of 4 to 6 carbon atoms where the nitrogen atom is substituted with a cyano group; or where $R_1$ and $R_2$ taken together with the amino nitrogen to which they are attached are part of a heterocyclic ring of 5 to 7 atoms containing in addition to the indicated nitrogen, one or two additional hetero atoms selected from the group consisting of O, S and N—$R_3$, where $R_3$ is hydrogen or a $C_1$–$C_5$ alkyl, $C_2$–$C_5$ alkenyl, $C_2$–$C_5$ alkynyl, phenyl, $C_7$–$C_9$ aralkyl, $C_5$–$C_7$ cycloalkyl, $C_1$–$C_5$ alkanoyl or cyano group, or another heterocyclic ring of 5 to 7 atoms containing one to three nitrogen atoms substituted with a cyano group, and where the carbon atoms of the first heterocyclic ring or substituent heterocyclic ring can be substituted with a $C_1$–$C_5$ alkyl, $C_1$–$C_5$ alkoxy, $C_1$–$C_5$ alkanoyl, middle halogen, amino, amine salt, cyano or cyanoamino group; or where $R_1$ and $R_2$ are the same or different and independently represent hydrogen, $C_1$–$C_{20}$ alkyl (straight chain, branched chain or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, $C_7$–$C_{20}$ aralkyl, alkenylcyanoamino or a polyalkenylamino of the type

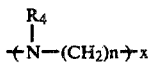

where n = 1–2 and x is 1–10 and $R_4$ is H or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or an amine salt, cyano, cyanoamino or hydroxyl group, provided that when either of $R_1$ or $R_2$ is hydrogen or a Group IA metal, the other of $R_1$ or $R_2$ is not hydrogen or a Group IA metal, and further provided that when either $R_1$ or $R_2$ is phenyl, the other of $R_1$ or $R_2$ is not hydrogen or a Group IA metal (c) a buffering agent to maintain the pH of the aqueous medium above 7 and (d) a bleachable substance.

19. The composition of claim 18 wherein the cyanoamine peroxide activator has an equivalent weight of about 44 to about 200.

20. The composition of claim 19 wherein the aqueous medium additionally contains a magnesium compound and a detergent.

21. The composition of claim 20 wherein the concentration of peroxide-based bleach in the aqueous medium is from 2 to about 12 millimoles/liter and the bleachable substance is a fabric.

22. The composition of claim 20 wherein the magnesium compound is a magnesium salt or oxide.

23. The composition of claim 22 wherein $R_1$ and $R_2$ taken together with the corresponding nitrogen represent morpholine, piperidine or N'-cyanopiperazine.

24. The composition of claim 18 wherein the cyanoamine is N,N'-dicyanopiperazine.

25. A built laundry detergent composition consisting essentially of (a) a major amount of a synthetic detergent and an alkaline detergent builder, (b) a minor amount of from 0.1 to 8% by weight, calculated as hydrogen peroxide, of a peroxide-based bleach, (c) a peroxide activating amount of a cyanoamine having an equivalent weight of about 44 to about 600 and represented by the formula:

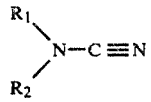

where $R_1$ and $R_2$ taken together with the amino nitrogen to which they are attached form a ring containing 4 to 6 carbon atoms, which carbon atoms may be substituted with a $C_1$–$C_5$ alkyl, $C_1$–$C_5$ alkoxy, $C_1$–$C_5$ alkanoyl, phenyl, middle halogen, amino, amine salt, cyano or cyanoamino group, or with a nitrogen-containing heterocyclic group of 4 to 6 carbon atoms where the nitrogen atom is substituted with a cyano group; or where $R_1$ and $R_2$ taken together with the amino nitrogen to which they are attached are part of a heterocyclic ring of 5 to 7 atoms containing in addition to the indicated nitrogen, one or two additional hetero atoms selected from the group consisting of O, S and N—$R_3$, where $R_3$ is hydrogen or a $C_1$–$C_5$ alkyl $C_2$–$C_5$ alkenyl, $C_2$–$C_5$ alkynyl, phenyl, $C_7$–$C_9$ aralkyl, $C_5$–$C_7$ cycloalkyl, $C_1$–$C_5$ alkanoyl or cyano group, or another heterocyclic ring of 5 to 7 atoms containing one to three nitrogen atoms substituted with a cyano group, and where the carbon atoms of the first heterocyclic ring or substituent heterocyclic ring can be substituted with a $C_1$–$C_5$ alkyl, $C_1$–$C_5$ alkoxy, $C_1$–$C_5$ alkanoyl, middle halogen, amino, amine salt, cyano or cyanoamino group; or where $R_1$ and $R_2$ are the same or different and independently represent hydrogen, $C_1$–$C_{20}$ alkyl (straight chain, branched chain or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, $C_7$–$C_{20}$ aralkyl, alkenylcyanoamino or a polyalkenylamino of the type

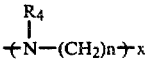

where n = 1–2 and x is 1–10 and $R_4$ is H or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or an amine salt, cyano, cyanoamino or hydroxyl group, provided that when either of $R_1$ or $R_2$ is hydrogen or a Group IA metal, the other of $R_1$ or $R_2$ is not hydrogen or a Group IA metal, and further provided that when either $R_1$ or $R_2$ is phenyl, the other of $R_1$ or $R_2$ is not hydrogen or a Group IA metal.

26. The composition of claim 25 which additionally contains a magnesium compound, the molar ratio of the magnesium compound to the peroxide-based bleach being from 1:60 to 25:1.

27. The composition of claim 25 wherein $R_1$ and $R_2$ taken together with the amino nitrogen to which they are attached represent morpholine, piperidine, or N'-cyanopiperazine.

28. The composition of claim 26 wherein the cyanoamine is N,N'-dicyanopiperazine.

* * * * *